US009708754B2

(12) United States Patent
Philip

(10) Patent No.: US 9,708,754 B2
(45) Date of Patent: Jul. 18, 2017

(54) LAUNDRY RECEPTACLES AND RELATED METHODS

(71) Applicant: Empee Solutions, LLC, Highland, UT (US)

(72) Inventor: Marvin Philip, Highland, UT (US)

(73) Assignee: Empee Solutions LLC, Highland, UT (US)

( * ) Notice: Subject to any disclaimer, the term of this patent is extended or adjusted under 35 U.S.C. 154(b) by 0 days.

(21) Appl. No.: 14/289,241

(22) Filed: May 28, 2014

(65) Prior Publication Data

US 2014/0263310 A1 Sep. 18, 2014

Related U.S. Application Data

(62) Division of application No. 13/542,316, filed on Jul. 5, 2012, now abandoned.

(51) Int. Cl.
*B65G 1/06* (2006.01)
*D06F 95/00* (2006.01)

(52) U.S. Cl.
CPC ..... *D06F 95/002* (2013.01); *Y10T 29/49826* (2015.01)

(58) Field of Classification Search
CPC .... B65G 1/06; B65G 1/08; B65G 1/07; D06F 95/002; D06F 95/004; B65F 1/06; B65F 1/1415; B65F 2210/18
USPC ..... 220/495.06, 495.08, 495.1, 495.11, 9.4
See application file for complete search history.

(56) References Cited

U.S. PATENT DOCUMENTS

| | | | | |
|---|---|---|---|---|
| 690,854 | A | 1/1902 | Grant | |
| 1,907,082 | A * | 5/1933 | Meltzer | 220/495.06 |
| 1,971,642 | A * | 8/1934 | Champlin | 248/97 |
| 2,007,997 | A * | 7/1935 | Beulke et al. | 220/9.4 |
| 2,082,995 | A * | 6/1937 | Wilcox | 229/117.35 |
| 2,115,122 | A | 4/1938 | Prudden | |
| 2,188,111 | A * | 1/1940 | Grandinetti | 383/107 |
| 2,225,089 | A * | 12/1940 | Vadnais | 383/43 |
| 2,848,032 | A | 8/1958 | Nist | |
| 3,128,904 | A * | 4/1964 | Reilly | 220/495.07 |
| 3,148,799 | A * | 9/1964 | Meroney | 220/495.11 |
| 3,233,644 | A * | 2/1966 | Bono | 220/9.1 |
| 3,235,212 | A | 2/1966 | Baumiller, Jr. | |

(Continued)

OTHER PUBLICATIONS

Great Expectations Study Notes; http://www.powerhousennuseum.com/pdf/education/Great_Expectations_Study_Notes.pdf; accessed Apr. 18, 2012; pp. 1-7; Powerhouse Museum; Sydney, Australia.

*Primary Examiner* — Stephen Castellano
(74) *Attorney, Agent, or Firm* — TraskBritt

(57) ABSTRACT

Liners for laundry receptacles are at least substantially comprised of an elastic material and include a peripheral edge, a central region, and an outer region between the peripheral edge and the central region. The outer region includes ridges and valleys each extending at least substantially parallel to the peripheral edge. Laundry receptacles include a frame including a top member and a liner coupled to the top member. The liner exhibits a modulus of elasticity of about 2,000 MPa or less and an elongation rating of about 100% or more. Methods of forming a laundry receptacle include forming a top member of a frame, forming a liner, and coupling the liner to the top member of the frame to hang the liner from the frame.

12 Claims, 6 Drawing Sheets

(56) References Cited

U.S. PATENT DOCUMENTS

| | | | | | |
|---|---|---|---|---|---|
| 3,349,936 | A | * | 10/1967 | Morton et al. | 217/3 BC |
| 3,396,885 | A | * | 8/1968 | Giondi | 224/438 |
| 3,659,913 | A | | 5/1972 | Waldron et al. | |
| 3,694,044 | A | | 9/1972 | Cummings | |
| 3,831,650 | A | * | 8/1974 | Consorti | 383/7 |
| 3,941,440 | A | | 3/1976 | Menzin et al. | |
| 4,083,392 | A | * | 4/1978 | Kobayashi | 220/9.4 |
| 4,096,987 | A | * | 6/1978 | Rodish | 383/119 |
| 4,109,571 | A | * | 8/1978 | Difley et al. | 100/35 |
| 4,120,335 | A | * | 10/1978 | Mitchell | 383/7 |
| 4,140,257 | A | * | 2/1979 | Peterson | 294/151 |
| 4,180,113 | A | * | 12/1979 | Liebling | 383/7 |
| 4,202,521 | A | | 5/1980 | Harding | |
| 4,248,442 | A | | 2/1981 | Barrett | |
| 4,300,611 | A | * | 11/1981 | Silverman | 312/35 |
| 4,347,948 | A | * | 9/1982 | Hamada et al. | 220/495.11 |
| 4,390,051 | A | * | 6/1983 | Cuthbertson | 383/111 |
| 4,549,673 | A | * | 10/1985 | Kupersmit | 229/117.02 |
| 4,646,802 | A | * | 3/1987 | Basore et al. | 220/9.4 |
| 4,807,712 | A | | 2/1989 | Skottegard | |
| 4,921,196 | A | * | 5/1990 | Rudko | 248/97 |
| 4,989,749 | A | * | 2/1991 | Choi | 280/47.34 |
| 5,170,906 | A | * | 12/1992 | Kochelek | 220/495.06 |
| 5,411,165 | A | * | 5/1995 | Ellis | 220/495.08 |
| 5,487,551 | A | | 1/1996 | Kennedy | |
| 5,507,577 | A | * | 4/1996 | Fowler | 383/7 |
| 5,518,136 | A | * | 5/1996 | Muldner et al. | 220/495.11 |
| 5,699,564 | A | * | 12/1997 | Heh | 5/503.1 |
| 5,735,608 | A | * | 4/1998 | Branco | 383/25 |
| 5,897,012 | A | * | 4/1999 | Sortwell | 220/4.28 |
| 5,947,314 | A | * | 9/1999 | Chilewich et al. | 220/9.4 |
| 6,017,040 | A | | 1/2000 | Mills | |
| 6,082,574 | A | * | 7/2000 | Johnson | 220/495.1 |
| 6,164,607 | A | | 12/2000 | Hawkes | |
| 6,394,651 | B2 | | 5/2002 | Jackson | |
| 6,676,092 | B2 | * | 1/2004 | Tsai | 248/97 |
| 6,679,398 | B1 | * | 1/2004 | O'Brien | 220/495.02 |
| 7,066,432 | B2 | * | 6/2006 | Wood et al. | 248/99 |
| 7,255,242 | B2 | * | 8/2007 | Shalit | 220/495.06 |
| 7,284,732 | B1 | * | 10/2007 | Lopa | 248/99 |
| 7,390,011 | B1 | * | 6/2008 | Hem | 280/638 |
| 8,887,941 | B2 | * | 11/2014 | Heintzman | 220/495.07 |
| 2002/0046981 | A1 | | 4/2002 | Amish | |
| 2008/0098773 | A1 | | 5/2008 | Beeks | |
| 2008/0197136 | A1 | * | 8/2008 | Dukes | 220/495.11 |
| 2009/0317022 | A1 | * | 12/2009 | Mackay | 383/71 |
| 2010/0111449 | A1 | | 5/2010 | Noble et al. | |
| 2011/0127270 | A1 | * | 6/2011 | Hartman et al. | 220/495.11 |

* cited by examiner

LAUNDRY RECEPTACLES AND RELATED METHODS

CROSS-REFERENCE TO RELATED APPLICATION

This application is a divisional of U.S. patent application Ser. No. 13/542,316, filed Jul. 5, 2012, abandoned, the disclosure of which is hereby incorporated herein in its entirety by this reference.

TECHNICAL FIELD

The present disclosure relates to receptacles for handling articles and, more specifically, to laundry receptacles (e.g., hampers, baskets, etc.), components thereof, and methods of forming laundry receptacles and components thereof.

BACKGROUND

Laundry receptacles are used to store and transport laundry, such as clothing, towels, and bedding. Often, to load a laundry machine with dirty laundry or to return clean laundry to a dresser or closet, laundry placed inside a laundry receptacle is removed by a person reaching into the laundry receptacle and removing articles of laundry. As laundry is removed from the laundry receptacle, the person must reach deeper into the laundry receptacle to retrieve those articles of laundry closer to a bottom of the laundry receptacle. If the laundry receptacle is placed on the floor, unloading the laundry receptacle may require bending and stooping to reach the articles of laundry toward the bottom of the laundry receptacle. Alternatively, some laundry receptacles may be placed on top of a washing machine (if space is available on the top of the washing machine) to better reach the laundry within the receptacle, which requires lifting the laundry receptacle to place it on the top of the washing machine. Some laundry receptacles include a fabric or mesh bag that is placed within a frame. When the bag is full of laundry, the bag may be lifted and removed from the frame to transport the laundry, such as to a laundry machine.

BRIEF SUMMARY

This summary is provided to introduce a selection of concepts in a simplified form. These concepts are described in further detail in the detailed description of embodiments of the disclosure below. This summary is not intended to identify key features or essential features of the claimed subject matter, nor is it intended to be used to limit the scope of the claimed subject matter.

In some embodiments, the present disclosure includes liners for laundry receptacles including a peripheral edge, a central region, and an outer region extending between the peripheral edge and the central region. The outer region includes ridges and valleys extending at least substantially parallel to the peripheral edge. The liners are at least substantially comprised of an elastic material.

In some embodiments, the present disclosure includes laundry receptacles including a frame comprising a top member and a liner coupled to the top member of the frame. The liner exhibits a modulus of elasticity of about 2,000 MPa or less and an elongation rating of about 100% or more.

In some embodiments, the present disclosure includes methods of forming a laundry receptacle. In accordance with such methods, a top member of a frame is formed and a liner is formed. The liner comprises an elastic material with an elongation rating of about 100% or more. The methods also include coupling the liner to the top member of the frame to hang the liner from the frame.

BRIEF DESCRIPTION OF THE DRAWINGS

While the specification concludes with claims particularly pointing out and distinctly claiming what are regarded as embodiments of the invention, the advantages of embodiments of the disclosure may be more readily ascertained from the description of certain examples of embodiments of the disclosure when read in conjunction with the accompanying drawings, in which:

DETAILED DESCRIPTION

The illustrations presented herein are not meant to be actual views of any particular material, structure, or device, but are merely idealized representations that are used to describe embodiments of the disclosure.

As used herein, the term "substantially," in reference to a given parameter, property, or condition, means to a degree that one of ordinary skill in the art would understand that the given parameter, property, or condition is met within a degree of variance, such as within acceptable manufacturing tolerances.

As used herein, any relational term, such as "on," "over," "under," "top," "bottom," "upper," "lower," "opposite," etc., is used for clarity and convenience in understanding the disclosure and accompanying drawings and does not connote or depend on any specific preference, orientation, or order, except where the context clearly indicates otherwise.

As used herein, the phrase "elongation rating," with reference to a material or structure, means and includes a percentage of an original length of the material or structure that the material or structure can elongate without breaking.

For example, a beam with a 100% elongation rating can be elongated to twice its original length without breaking, and a beam with a 200% elongation rating can be elongated to three times its original length without breaking.

The present disclosure includes laundry receptacles with a liner configured to extend under weight of one or more articles placed therein to increase volume within the liner and to contract as articles are removed to decrease volume within the liner and bring laundry within the liner closer to a mouth of the liner. The liner may be formed of an elastic material selected to have an elongation rating of 100% or more. In some embodiments, the liner may be capable of holding up to about 30 lbs (13.6 kg) or more of articles of laundry without breaking Frame members of the laundry receptacles may comprise components assembled in configurations that enable them to be compactly stored prior to assembly or when dismantled. The laundry receptacles may include one or more rollers connected to frame members for transporting the laundry receptacles from one location to another.

Figure 2:
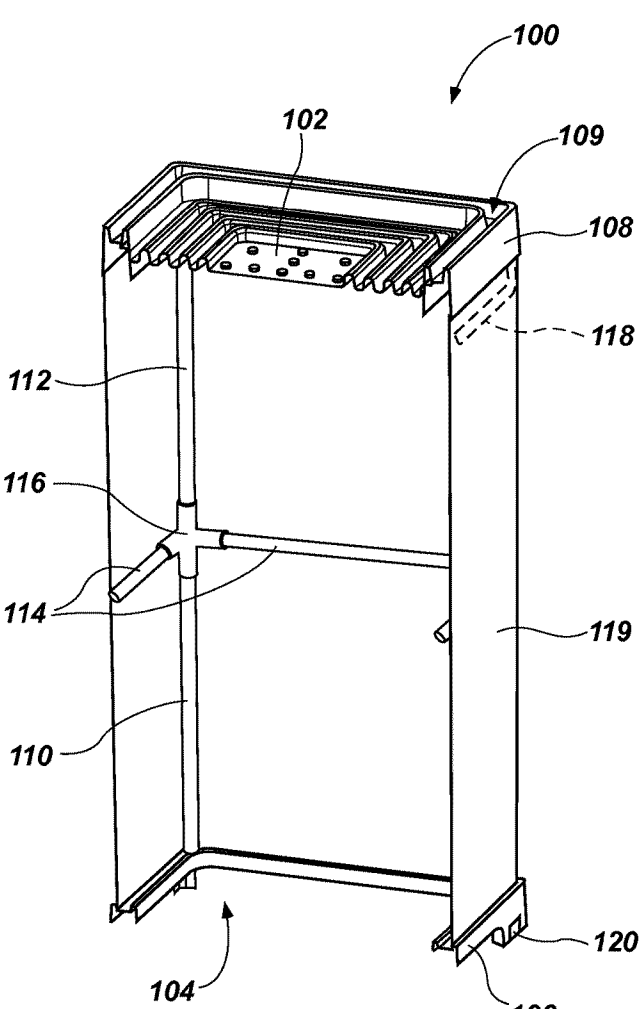
FIG. 2 is a cross-sectional perspective view of the laundry receptacle of FIG. 1 showing internal components of the laundry receptacle.
Figure 1:
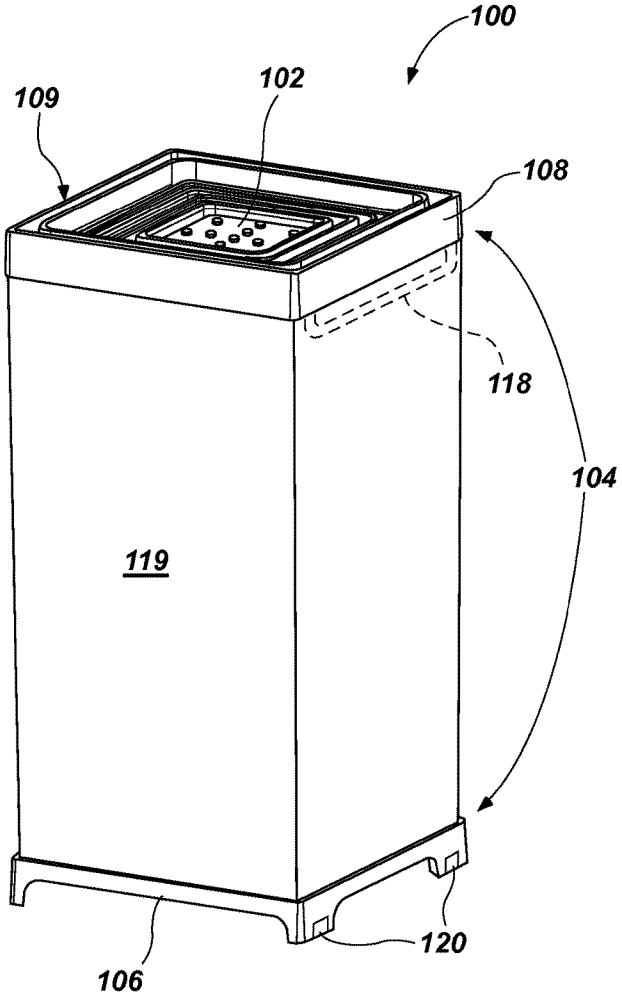
FIG. 1 is a perspective view of a laundry receptacle according to an embodiment of the present disclosure.

Referring to FIGS. 1 and 2, a laundry receptacle 100 of the present disclosure includes a liner 102 coupled to a frame 104, such as along a peripheral edge of the liner 102, to hang the liner 102 from the frame 104. The frame 104 may include a base member 106 and a top member 108. In some embodiments, the peripheral edge of the liner 102 may be shaped and sized to fit at least partially inside a groove 109 formed in the top member 108 of the frame 104, for example. Since the liner 102 may be formed of an elastic material, as will be explained in more detail below, the peripheral edge of the liner 102 may be expanded (i.e., stretched) to extend over an inner portion of the top member 108 defining an inner wall of the groove 109, and the elasticity of the liner 102 may be used to hold the liner 102 in place relative to the top member 108. In some embodiments, at least one of a fastener, mechanical interference, and an adhesive may be used to secure the liner 102 to the top member 108 of the frame 104.

As shown in FIG. 2, the frame 104 may also include lower vertical members 110 that are coupled to the base member 106 and upper vertical members 112 that are coupled to the top member 108. The lower vertical members 110 and upper vertical members 112 may be coupled to each other and to horizontal members 114 with frame brackets 116. Alternatively, in some embodiments, respective pairs of lower vertical members 110 and upper vertical members 112 may be replaced by single vertical members extending from the base member 106 to the top member 108. An outer shell 119 may cover at least portions of the frame 104 to provide improved aesthetics to the laundry receptacle 100. Optionally, a handle 118 (shown in broken lines) may be a part of or coupled to the top member 108 to facilitate transportation of the laundry receptacle 100. In some embodiments, one or more rollers 120 may be coupled to the base member 106 for rolling the laundry receptacle 100 from one location to another.

Each of the components of the frame 104 may be formed of a relatively rigid material for structurally supporting other components (e.g., the liner 102, the outer shell 119, the optional handle 118) of the laundry receptacle 100 and laundry (or other articles or materials) placed within the laundry receptacle 100. By way of example and not limitation, one or more of the components of the frame 104 may comprise a rigid polymer material, such as at least one of acrylonitrile butadiene styrene (ABS), polypropylene (PP), polyvinyl chloride (PVC), chlorinated PVC (CPVC), and high density polyethylene (HDPE). In some embodiments, one or more of the components of the frame 104 may comprise a metal, such as steel, aluminum, or an aluminum alloy, for example.

Figure 3:
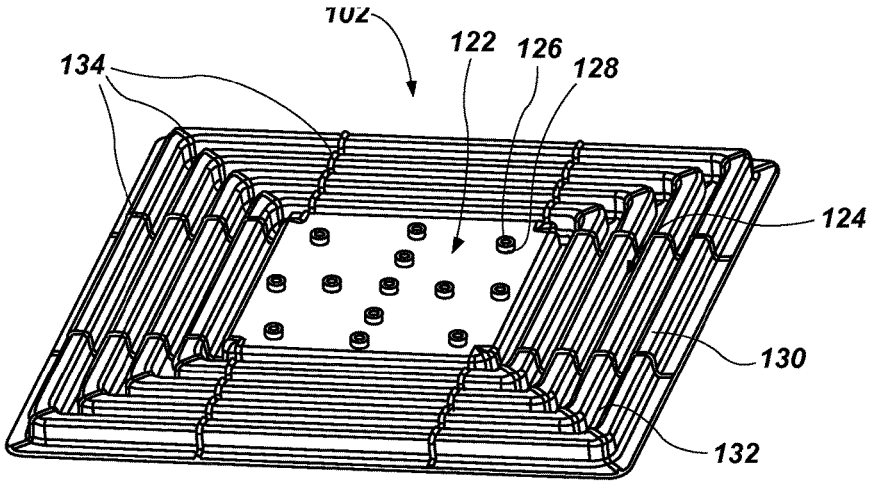
FIG. 3 is a perspective view of a liner of the present disclosure.

Referring to FIG. 3, the liner 102 may include a central region 122 and an outer region 124. At formation of the liner 102, the central region 122 may be generally planar, as shown in FIG. 3. Holes 126 may be formed in the central region 122 to provide breathability in the liner 102, if desired. Although not shown, additional holes 126 may also be formed in the outer region 124. In some embodiments, as shown in FIG. 3, an annular reinforcing material 128 may be formed around each hole 126 to inhibit tearing of the liner 102 when expanded. If present, the annular reinforcing material 128 may be formed on one or both opposing sides of the liner 102. Alternatively, an annular reinforcing ring (not shown) in the form of a rivet may be inserted into each hole 126 and crimped.

The outer region 124 of the liner 102 may include substantially concentric ridges 130 and valleys 132, which provide increased surface area and volume to the liner 102. The increased surface area and volume of the liner 102 may enable the liner 102 to expand to a greater extent than if the liner 102 were substantially fully planar. The ridges 130 and valleys 132 may each extend in a direction parallel to a peripheral edge of the liner 102. In applications where the liner 102 is to be expanded to a lesser extent, the liner 102 may be formed to include fewer or no ridges 130 and valleys 132. Conversely, in applications where the liner 102 is to be expanded to a greater extent, additional ridges 130 and valleys 132 may be formed. For example, the central region 122 may also include ridges 130 and valleys 132. By way of another example, the outer region 124 may include a greater number of ridges 130 and valleys 132 than is shown in FIG. 3.

The liner 102 may include ribs 134 of additional material extending from the peripheral edge of the liner 102 toward the central region 122. The ribs 134 may provide additional strength and rigidity to the liner 102. In the embodiment shown in FIG. 3, the liner 102 includes three ribs 134 of additional material associated with each corner region of the liner 102, each rib 134 extending across the outer region 124 to an edge of the central region 122. The length, cross-sectional size, and/or quantity of the ribs 134 may be increased in applications where articles and/or material of greater weight is to be carried by the liner 102 or in applications where the liner 102 is to be expanded to a lesser extent under a given weight. For example, the liner 102 may additionally or alternatively include ribs 134 extending from a middle region of a peripheral edge (e.g., substantially midway between adjacent corners of the liner) toward the central region 122 of the liner 102. By way of another example, the ribs 134 may extend substantially fully across the liner 102, including across the central region 122. Conversely, the length, cross-sectional size, and/or quantity of the ribs 134 may be decreased in applications where articles and/or material of lesser weight is to be carried by the liner 102 or in applications where the liner 102 is to be expanded a greater distance. The ribs 134 may be continuous or discontinuous. Thus, at least one of the presence, quantity, size, location, and configuration of the ribs 134 may be modified to tailor structural and functional characteristics of the liner 102.

The liner 102 may comprise an elastic material that enables the liner 102 to expand and contract in response to articles or material being placed in the liner 102. As used herein, the phrase "elastic material" means and includes material that generally has a low modulus of elasticity and a high elongation rating compared to other materials. Simply stated, the modulus of elasticity of a material is a measure of resistance to deformation of the material. For example, a material of a certain shape with a low modulus of elasticity is more easily deformed than a material of the same shape with a high modulus of elasticity. By way of example and not limitation, the liner 102 may be formed of an elastic material having a modulus of elasticity of about 2,000 MPa or less. In some embodiments, the elastic material of the liner 102 may have a modulus of elasticity about 1,000 MPa or less. In some embodiments, the elastic material of the liner 102 may have a modulus of elasticity of about 100 MPa or less. In some embodiments, the elastic material of the liner 102 may have a modulus of elasticity of about 20 MPa or less.

Elongation rating is generally a measure of how far a material can be elongated without breaking, and is expressed as a percentage of an original length of a sample of the material. The liner 102 of the present disclosure may have an elongation rating of about 100% or more. In some embodiments, the liner 102 may have an elongation rating of about 200% or more. In some embodiments, the liner 102 may have an elongation rating of about 300% or more.

By way of example and not limitation, the liner 102 may be capable of holding up to about 30 lbs (13.6 kg) or more of laundry without breaking In some embodiments, the liner 102 may be capable of holding up to about 50 lbs (22.7 kg) of laundry without breaking, for example.

Elastic material for the liner 102 may be selected to exhibit the characteristics of elasticity described above and may be selected based on the intended application of the laundry receptacle 100 (FIGS. 1 and 2). By way of example and not limitation, the liner 102 may comprise an elastic polymer, such as one or more of a thermoplastic elastomer (TPE) (e.g., a polyolefin TPE), a thermoset elastomer (TSE), natural rubber (e.g., latex), synthetic rubber (e.g., chloroprene, silicone, nitrile, etc.), polyurethane, and nylon. Processes used to form structures from such elastic materials are known in the art and are, therefore, not described in detail in the present disclosure. For example, if a TPE material is used, the liner 102 may be formed by an injection molding process. In some embodiments, the liner 102 including each of its features (e.g., the annular reinforcing material 128, ridges 130, valleys 132, ribs 134, etc.) may be a unitary body of the selected elastic material. In some embodiments, materials of differing properties may be used, for example, in different features of the liner 102. One material may be used for the central region 122 and the ridges 130 and valleys 134, while another material may be used for the ribs 134. In one example, two different densities of polyurethane may be molded to form the different features of the liner 102.

As noted above, the liner 102 may be shaped and sized to be coupled to the frame 104 of the laundry receptacle 100 (FIGS. 1 and 2). Therefore, although the liner 102 is shown as being generally rectangular for coupling to a generally rectangular top member 108 of the frame 104, the present disclosure is not so limited. For example, the liner 102 may have a shape selected from rectangular, square, circular, triangular, polygonal, and irregular for coupling to a top member 108 of a frame 104 having a corresponding shape.

Figure 4:
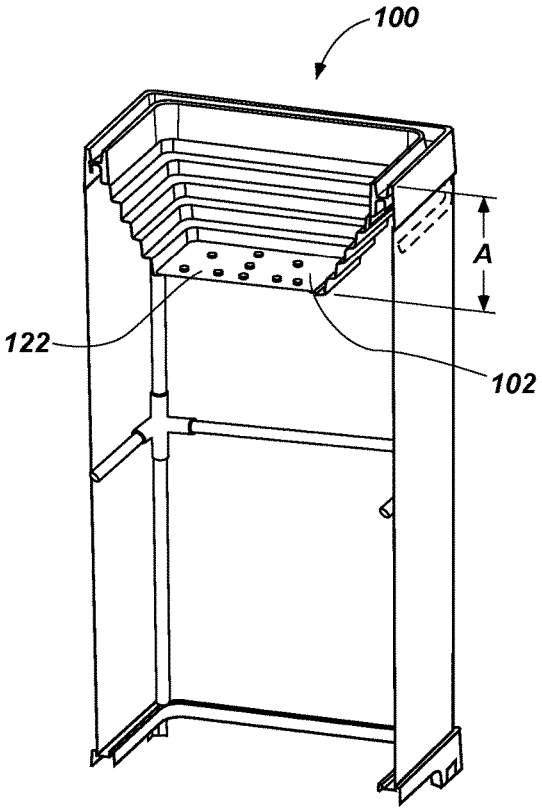
FIG. 4 is a cross-sectional perspective view of the laundry receptacle of FIG. 1 including the liner of FIG. 3 in a relaxed, empty state.

Referring to FIG. 4, the central region 122 of the liner 102 may hang a distance A from a top of the laundry receptacle 100 when in a relaxed, empty state. In other words, the elasticity of the liner 102 in conjunction with the weight of the liner 102 may result in some sagging of the liner 102. As articles of laundry are placed in the laundry receptacle 100 on the liner 102, the distance A that the central region 122 of the liner 102 hangs may increase based on the weight of the articles of laundry. As additional articles of laundry are placed in the laundry receptacle 100, the distance A may continue to increase based on the additional weight.

Figure 5:
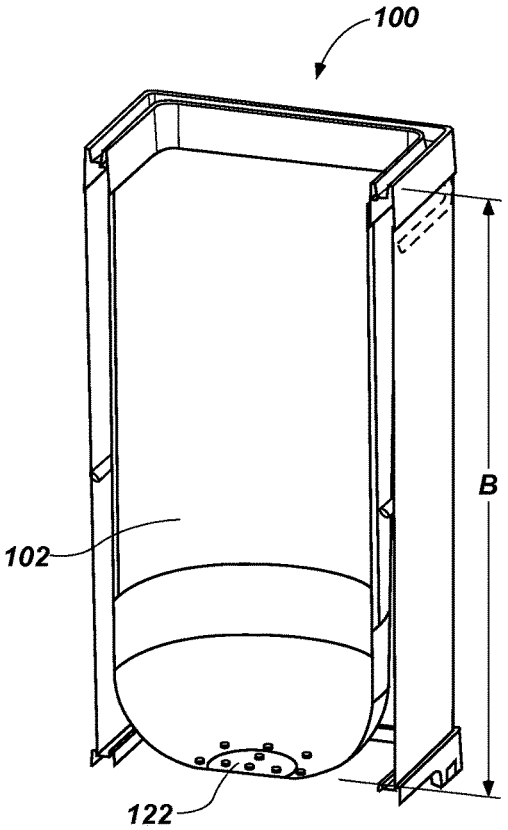
FIG. 5 is a cross-sectional perspective view of the laundry receptacle of FIG. 1 including the liner of FIG. 3 in a fully expanded state.

Referring to FIG. 5, when the laundry receptacle 100 is full of laundry (laundry is not shown in FIG. 5 for clarity), the liner 102 may be fully expanded and the central region 122 may hang a distance B from the top of the laundry receptacle 100.

Conversely, as articles of laundry are removed from the liner 102 of the laundry receptacle 100, the liner 102 may contract due to the elasticity of the liner 102 in conjunction with the reduced weight of laundry in the laundry receptacle 100. In other words, the distance B that the central region 122 hangs when articles of laundry are in the liner 102 may incrementally reduce as articles of laundry are removed. Thus, laundry remaining in the laundry receptacle 100 may be elevated by the elasticity of the liner 102 as articles of laundry are removed. After all the laundry is removed from within the laundry receptacle 100, the liner 102 may return to a relaxed, empty state, as shown in FIG. 4.

The contraction of the liner 102 as articles of laundry (or any other articles or material) are removed from the laundry receptacle 100 may enable a person using the laundry receptacle 100 to avoid bending and reaching into the laundry receptacle 100 to retrieve and remove the articles of laundry, especially articles toward a bottom of a pile of laundry within the laundry receptacle 100. In other words, a top of the pile of laundry may be elevated such that the articles of laundry are accessible to a person standing proximate the laundry receptacle 100 substantially without bending or stooping. Such a feature may reduce a likelihood of injuries (e.g., back injuries), enable a person with reduced muscular strength and flexibility to remove the laundry from the laundry receptacle 100, and/or improve the speed and efficiency with which a person may remove the laundry.

Figure 6:
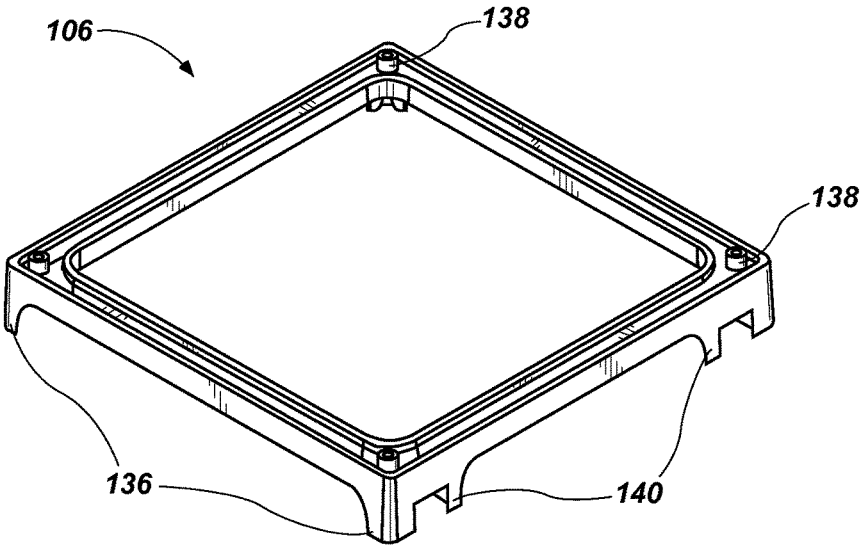
FIG. 6 is a perspective view of a base member of a frame of the laundry receptacle of FIG. 1.

Referring to FIG. 6, the base member 106 of the frame 104 (FIGS. 1 and 2) may, in some embodiments, have a generally rectangular shape, although other shapes are contemplated, as described above. Feet may extend from a bottom surface of the base member 106 at each corner to provide stability to the base member 106, and ultimately to the laundry receptacle 100 (FIGS. 1 and 2), when positioned on a surface. A feature 138 for assembling other portions of the frame 104 with the base member 106 may be located proximate each corner of the base member 106. For example, each of the features 138 may comprise a protrusion extending from an upper surface of the base member 106, as shown in FIG. 6, around which a lower vertical member 110 (FIG. 2) may be seated. In other embodiments, each feature 138 may comprise a recess (not shown) in which an end of the lower vertical member 110 may be seated. Extensions 140 may also extend from a bottom surface of the base member 106. The extensions 140 may be located and configured to couple roller elements 120 (FIGS. 1 and 2) to the base member 106. The base member 106 may be at least substantially comprised of a single, unitary body, as shown in FIG. 6. In other embodiments, the base member 106 may include two or more components that are assembled together to form the base member 106.

Although the base member 106 is shown in FIG. 6 without any material in a central region thereof (e.g., the base member 106 is defined by material only along a peripheral edge thereof), the present disclosure is not so limited. For example, the base member 106 may include a plate (not shown) or bar extending across a central portion thereof. Such a plate or bar, if present, may improve structural stability of the base member 106 and may provide a structure for inhibiting expansion of the liner 102 (FIG. 6) beyond the base member 106.

Figure 7A:
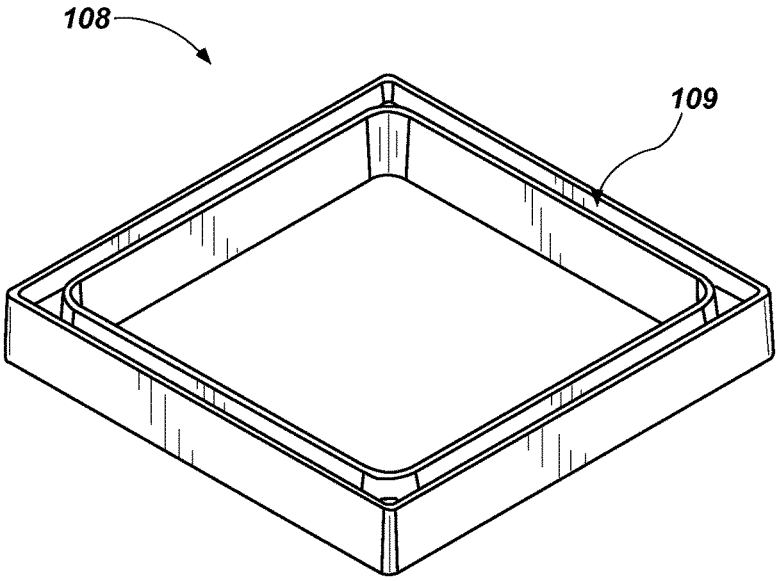
FIG. 7A is a perspective view of a top member of the frame of the laundry receptacle of FIG. 1.
Figure 7B:
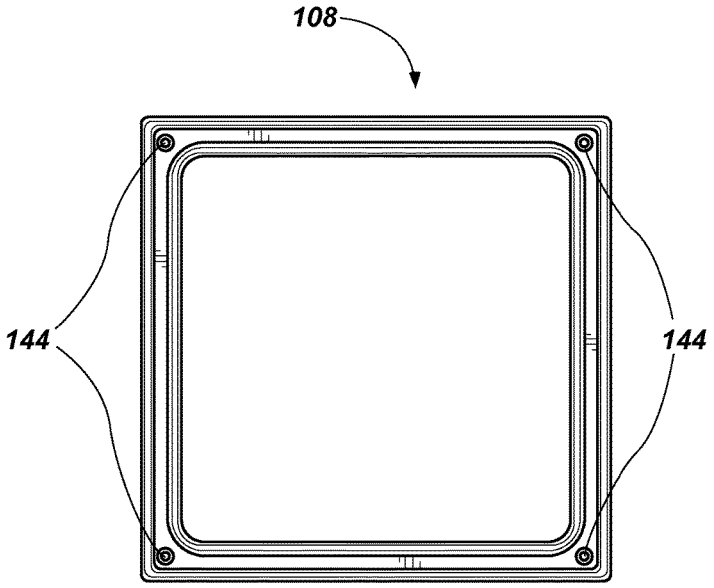
FIG. 7B is a bottom view of the top member of FIG. 7A.

Referring to FIGS. 7A and 7B, the top member 108 of the frame 104 (FIGS. 1 and 2) may, in some embodiments, have a generally rectangular shape, although other shapes are contemplated, as described above. As noted above and as shown in FIG. 7A, the top member 108 may include a groove 109 extending into the top member 108 from a top surface thereof. The groove 109 may be provided in the top member 108 to enable a portion (e.g., a peripheral edge) of the liner 102 (FIGS. 1 and 2) to be positioned within the groove 109, as described above. The groove 109 may also improve structural stability of the top member 108. As shown in FIG. 7B, a lower surface of the top member 108 may include features 144 located proximate corners thereof for assembling other portions of the frame 104 (FIG. 2) with the top member 108. For example, each of the features 144 may comprise a protrusion extending from a lower surface of the top member 108, as shown in FIG. 7B, around which an upper vertical member 112 (FIG. 2) may be seated. In other embodiments, each feature 144 may comprise a recess (not shown) in which an end of the upper vertical member 112 may be seated. The top member 108 may be at least substantially comprised of a single, unitary body, as shown in FIG. 6. In other embodiments, the top member 108 may include two or more components that are assembled together to form the top member 108.

Referring to FIG. 6 in conjunction with FIGS. 7A and 7B, the base member 106 and the top member 108 may have a similar shape (e.g., rectangular). The base member 106 may be sized and configured to at least partially nest within a cavity formed in the top member 108 to reduce a volume that the base member 106 and top member 108 occupy prior to being assembled or while dismantled. Thus, the base member 106 and the top member 108 may be compactly shipped and/or stored, which may save space, shipping costs, and/or storage costs.

As noted above, the base member 106 and the top member 108 may be formed of a material such as a rigid polymer material or a metal. Processes for forming these materials into the desired shape are known in the art and are, therefore, not described in detail in the present disclosure. For example, in embodiments where the base member 106 and the top member comprise a rigid polymer material, the base member 106 and the top member 108 may be formed by injection molding or by thermoforming, for example.

Figure 8A:
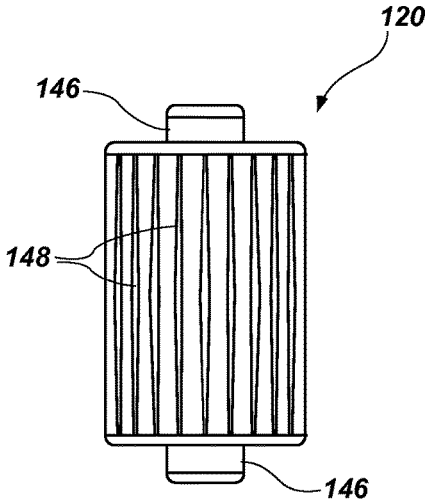
FIG. 8A is a side view of a roller of the laundry receptacle of FIG. 1.
Figure 8B:
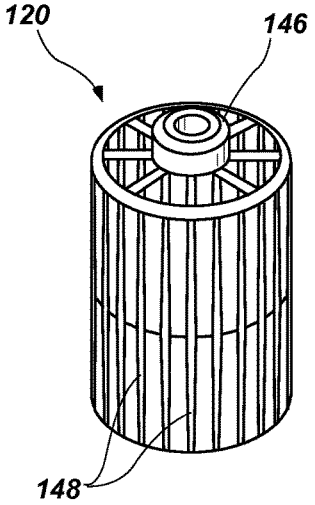
FIG. 8B is a perspective view of the roller of FIG. 8A.

Referring to FIGS. 8A and 8B, the one or more rollers 120 may be generally cylindrical. Attachment features 146 may be provided on each longitudinal end of the one or more rollers 120 for coupling to the base member 106, such as between a respective foot 136 and extension 140 of the base member 106 (FIG. 6). An outer surface of the one or more rollers 120 may be textured for improved rolling along a surface. For example, longitudinally extending recesses 148 may be formed in the outer surface of the one or more rollers 120. As shown in FIG. 1, in some embodiments, the laundry receptacle 100 may include two rollers 120 coupled to a lateral side of the base member 106 of the frame 104. Thus, the laundry receptacle 100 may be transported from one location to another by tilting and rolling the laundry receptacle 100 on the two rollers 120.

The one or more rollers 120 may be formed of a rigid polymer material. By way of example and not limitation, the one or more rollers 120 may comprise at least one of ABS, PP, PVC, CPVC, and HDPE.

As noted above with reference to FIGS. 1 and 2, the laundry receptacle 100 may include an outer shell 119 that covers at least portions of the frame 104. The outer shell 119 may improve aesthetics of the laundry receptacle 100 by covering the frame 104 and by enabling the laundry receptacle 100 to have a variety of decorations and styles (e.g., color, pattern, texture, etc.). Such decorations and styles may be selected by the owner to suit individual taste and decor. The outer shell 119 may include, for example, at least one of a woven fabric (e.g., linen, canvas, etc.), a nonwoven fabric (e.g., felt), a polymer sheet, wood, basketry, and sheet metal. Although the drawings show the outer shell 119 extending only around portions of lateral sides of the frame 104, in some embodiments the outer shell 119 may also extend over at least a portion of a top surface of the top member 108 of the frame 104.

Although the embodiments of the present disclosure have referred to the laundry receptacle 100 for storing and transporting articles of laundry, the present disclosure also includes receptacles for articles or materials other than laundry. By way of non-limiting example, the receptacle described above or a similar receptacle may be used for storing and/or transporting one or more of toys, tools, trash, papers, books, shoes, food, etc. The material and configuration of the liner 102 may be selected to exhibit characteristics suitable for storing and/or transporting a particular article, material, or combination of articles and/or materials. For example, a receptacle for carrying relatively heavy (e.g., more dense) articles may include a liner exhibiting a relatively higher modulus of elasticity than a receptacle for carrying relatively light (e.g., less dense) articles, to elevate the relatively heavy articles closer to the top of the receptacle as the articles are removed. Thus, receptacles and liners according to embodiments of the present disclosure may be tailored for a specific use, including for receiving laundry or other articles or materials.

The present disclosure also includes methods of forming receptacles, such as the laundry receptacle 100. Referring again to FIGS. 1 through 3, the laundry receptacle 100 may be formed by forming the frame 104, forming the liner 102, and coupling the liner 102 to the frame 104. For example, the top member 108 of the frame 104 may be formed, and the liner 102 may be coupled to the top member 108, as described above. The liner 102 may be formed to exhibit the characteristics (e.g., elongation rating, weight capacity, modulus of elasticity, shape, etc.) described above. In some embodiments, the liner 102 may be formed by forming a unitary body of elastic material.

Referring again to FIG. 3, forming the liner 102 may include forming the generally planar central region 122 and the outer region 124 including the ridges 130 and valleys 132. The holes 126 may be formed in at least one of the central region 122 and the outer region 124, along with the annular reinforcing material 128 surrounding at least some of the holes 126. As noted above, the liner 102 may be formed to include the ribs 134 of the elastic material extending from a peripheral edge of the liner 102 toward, and optionally through, the central region 122. The liner 102 may be formed in a shape and size corresponding to a shape and size of the top member 108 of the frame 104, to facilitate coupling the liner 102 to the top member 108.

The frame 104 may be formed by forming each of the components of the frame 104, such as the base member 106, the top member 108, the lower vertical member 110, the upper vertical members 112, the horizontal members 114, the frame brackets 116, the handle 118, and the outer shell 119, as described above. After formation, the components of the frame 104 may be assembled. Alternatively, two or more of the components of the frame may be formed as a unitary body to reduce or eliminate one or more assembly operations. One or more rollers 120 may be coupled to the base member 106, as described above.

Figure 10:
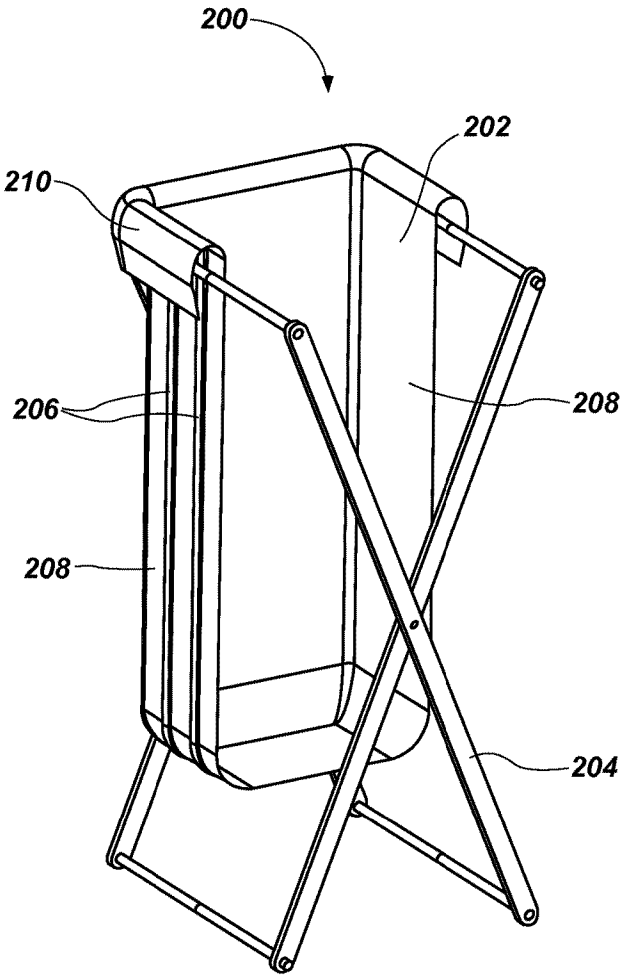
FIG. 10 is a perspective view of the laundry receptacle of FIG. 9 showing a liner thereof in cross-section.
Figure 9:
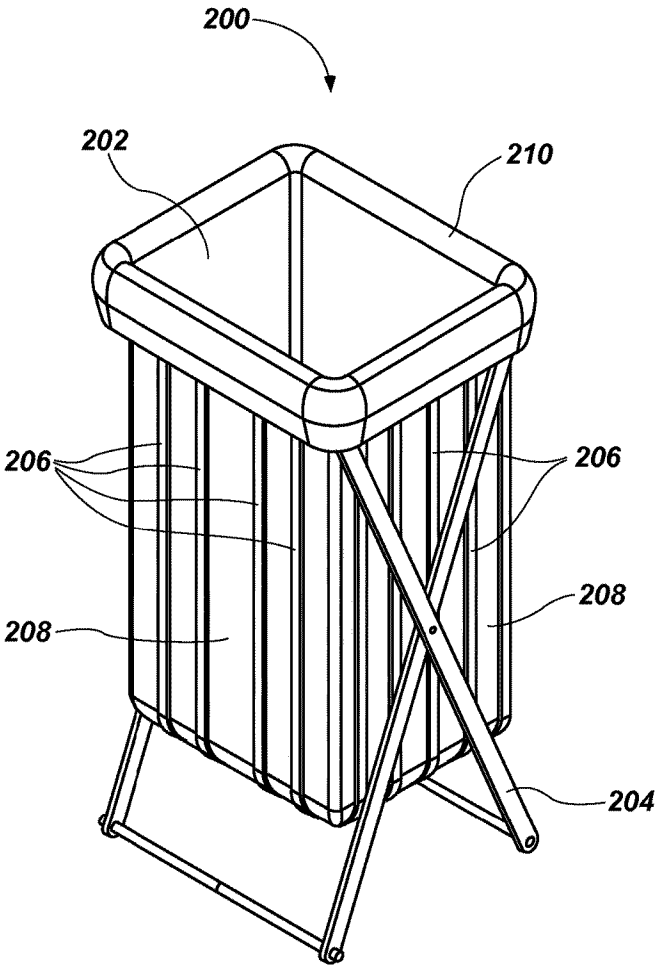
FIG. 9 is a perspective view of a laundry receptacle according to another embodiment of the present disclosure.
Figure 11C:
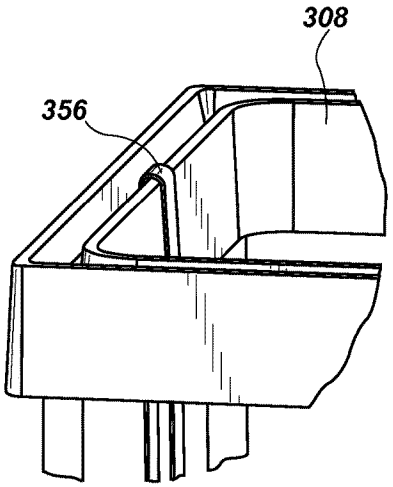
FIG. 11C is a detailed view of a portion of the laundry receptacle of FIG. 11A, taken at circle 11C in FIG. 11A.
Figure 11B:
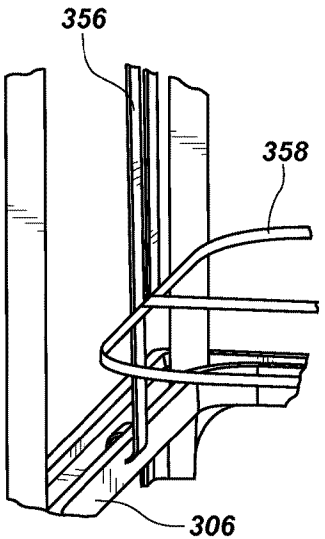
FIG. 11B is a detailed view of a portion of the laundry receptacle of FIG. 11A, taken at circle 11B in FIG. 11A.
Figure 11A:
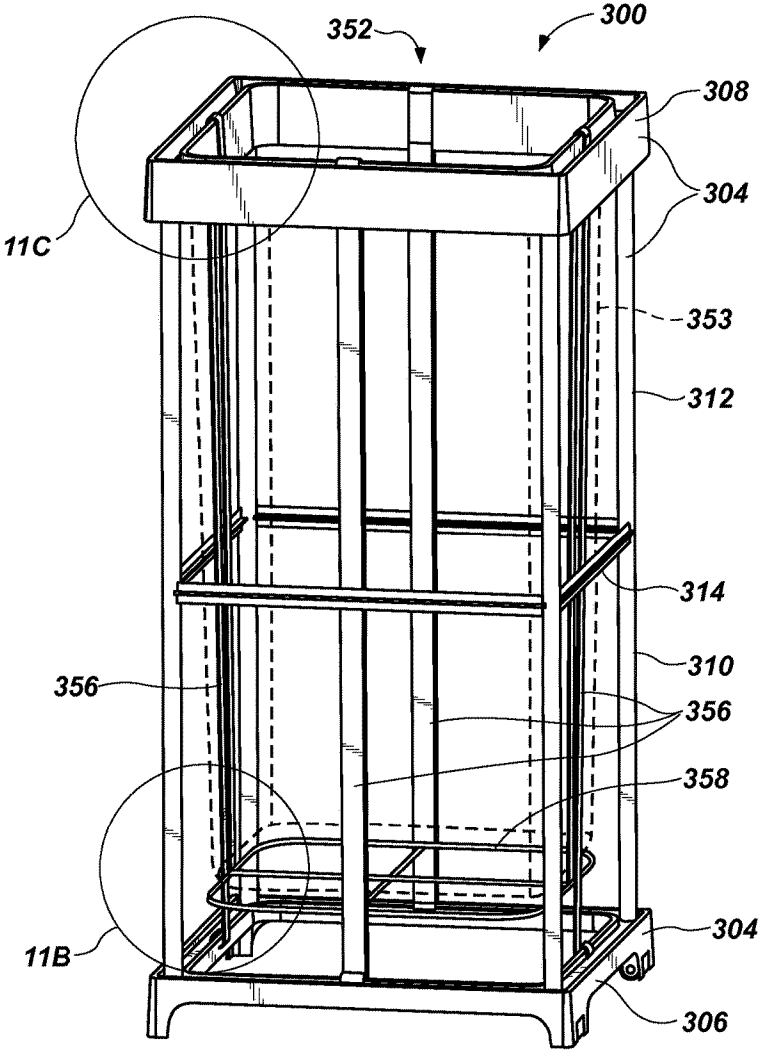
FIG. 11A is perspective view of a laundry receptacle according to another embodiment of the present disclosure.

Although the liner 102 has been shown and described above as a unitary body of an elastic material, the present disclosure is not so limited. For example, a liner of the present disclosure may comprise an elastic woven cloth. In another example, a liner of the present disclosure may comprise a flexible bag with bands of elastic material coupled to the flexible bag, as shown in FIGS. 9 and 10 and described in more detail below. By way of another example, a liner of the present disclosure may comprise a relatively flexible bag resting against bands of elastic material, such that the bands of elastic material lift the flexible bag as laundry is removed, as shown in FIGS. 11A through 11C and described in more detail below.

Referring to FIGS. 9 and 10, a laundry receptacle 200 according to another embodiment is shown. The laundry receptacle 200 may include a liner 202 coupled to a frame 204. The frame 204 may be a prior known X-frame for a laundry hamper, as shown in FIGS. 9 and 10. In other embodiments, the frame 204 may be substantially similar to the frame 104 (FIG. 2) described above.

The liner 202 may include a plurality of elastic bands 206 coupled to (e.g., integrated with) a flexible bag 208. By way of non-limiting example, the elastic bands 206 may be sewn to or into the flexible bag 208, may extend through one or more channels formed in or associated with the flexible bag 208, or may be woven into material of the flexible bag 208. The elastic bands 206 may include any of the elastic materials describe above with reference to the liner 102. The elastic bands 206 may have an elongation ratio of about 100% or above, about 200% or above, or even about 300% or above. The elastic bands 206 may have a modulus of elasticity of about 2,000 MPa or less, about 1,000 MPa or less, about 100 MPa or less, or even about 20 MPa or less.

The flexible bag 208 may comprise at least one of a woven fabric (e.g., linen, canvas, etc.), a nonwoven fabric, and a polymer material. The flexible bag 208 may be sufficiently flexible to be lowered and raised by the elastic bands 206 depending on the amount of laundry or other material within the laundry receptacle 200, essentially as described above with reference to FIGS. 4 and 5. The liner 202 is illustrated in FIGS. 9 and 10 in a fully expanded position.

The liner 202 may also include a lip 210 for coupling the liner 202 to the frame 204. By way of example and not limitation, the lip 210 may comprise a rigid member configured to extend over and around a top of the frame 204, as shown in FIGS. 9 and 10. Such a rigid member may be formed of a polymer material, a metal material, or another relatively rigid material. In some embodiments, the lip 210 may include a plurality of rigid members, such as hooks, to hold the liner 202 in place relative to the frame 204. By way of another example, the lip 210 may simply be a portion of the flexible bag 208 that is sized and configured to be folded over the top of the frame 204. Such a flexible lip 210 may, in some embodiments, also include a rope or other line coupled to the lip 210 to cinch the lip 210 around the top of the frame 204 to at least temporarily secure the liner 202 in place relative to the frame 204.

Referring to FIGS. 11A through 11C, a laundry receptacle 300 according to another embodiment of the present disclosure is shown. The laundry receptacle 300 may include a frame 304 and a liner 352, the liner 352 comprising elastic bands 356 and a flexible bag 353 (shown in FIG. 11A in dashed lines) resting against the elastic bands 356. The flexible bag 353 may also rest against a rigid liner base 358 that is coupled to the elastic bands 356.

The elastic bands 356 may include any of the elastic materials describe above with reference to the liner 102. The elastic bands 356 may have an elongation ratio of about 100% or above, about 200% or above, or even about 300% or above. The elastic bands 356 may have a modulus of elasticity of about 2,000 MPa or less, about 1,000 MPa or less, about 100 MPa or less, or even about 20 MPa or less.

The frame 304 may be similar to the frame 104 (FIG. 2) described above in that the frame 304 may include a base member 306, a top member 308, lower vertical members 310, upper vertical members 312, and horizontal members 314. However, the top member 308 may be different from the top member 108 described above in that the top member 308 may include slots or holes (not shown) through which the elastic bands 356 may extend. The base member 306 may also include slots or holes for coupling ends of the elastic bands 356 thereto. Additionally or alternatively, an adhesive and/or a fastener (not shown) may be used for coupling ends of the elastic bands 356 to the base member 306.

As shown in FIGS. 11A through 11C, one end of each of the elastic bands 356 may be coupled (e.g., attached) to the base member 306 of the frame 304. Each of the elastic bands 356 may loop up and over a portion of the top member 308 of the frame 304. Another end of each of the elastic bands 356 may be attached to the rigid liner base 358, which may be disposed at least partially within the frame 304. Thus, the rigid liner base 358 may be lowered and raised by the elastic bands 356 depending on the amount of laundry or other material within the laundry receptacle 300, essentially as described above with reference to FIGS. 4 and 5. The flexible bag 353 resting on the rigid liner base 358 may likewise be lowered and raised by the elastic bands 356 in response to the rigid liner base 358 lowering and raising.

The flexible bag 353 may comprise at least one of a woven fabric (e.g., linen, canvas, etc.), a nonwoven fabric, and a polymer material. By way of non-limiting example, the flexible bag 353 may be a prior known fabric, mesh, or plastic bag used in storing and/or carrying laundry. The flexible bag 353 may be sufficiently flexible to be lowered and raised by the elastic bands 356 and the rigid liner base 358 depending on the amount of laundry or other material within the laundry receptacle 300, essentially as described above with reference to FIGS. 4 and 5. The liner 352, including the flexible bag 353, the elastic bands 356, and the rigid liner base 358, is illustrated in FIG. 11A in a fully expanded position.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this invention. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and legal equivalents.

What is claimed is:

1. A laundry receptacle, comprising:

a frame comprising a base member at a bottom of the frame and a top member at a top of the frame; and a liner coupled to and hanging from the top member of the frame toward the base member of the frame, the liner comprising a flexible bag and a plurality of elastic bands coupled to the flexible bag, the plurality of elastic bands exhibiting a modulus of elasticity of about 2,000 MPa or less and an elongation rating of about 100% or more, wherein each elastic band of the plurality of elastic bands is attached to the base member proximate a first end of each elastic band, loops up and over a portion of the top member, and is coupled to a bottom of the flexible bag proximate a second end of each elastic band to raise the bottom of the flexible bag toward the top member upon removal of laundry from within the flexible bag.

2. The laundry receptacle of claim 1, wherein the liner has a shape corresponding to a shape of the top member of the frame.

3. The laundry receptacle of claim 1, wherein the liner comprises a central region and an outer region, at least one of the central region and the outer region comprising ridges each extending in a direction parallel to a peripheral edge of the liner.

4. The laundry receptacle of claim 1, wherein a peripheral edge of the liner is positioned at least partially within a groove of the top member.

5. The laundry receptacle of claim 1, wherein the plurality of elastic bands of elastic material coupled to the flexible bag exhibit a modulus of elasticity of about 1,000 MPa or less and an elongation rating of about 200% or more.

6. The laundry receptacle of claim 1, further comprising one or more rollers coupled to the base member of the frame for rolling the laundry receptacle from one location to another location.

7. The laundry receptacle of claim 1, wherein the frame further comprises:

lower vertical members coupled to the base member;

horizontal members coupled to the lower vertical members with frame brackets; and upper vertical members coupled to the horizontal members and lower vertical members with the frame brackets and coupled to the top member.

8. The laundry receptacle of claim 1, wherein the plurality of elastic bands extend through one or more channels formed in the flexible bag of the liner.

9. A method of forming a laundry receptacle, comprising:

forming a top member defining a top of a frame and a bottom member defining a bottom of the frame;

forming a liner comprising a flexible bag;

coupling bands of elastic material proximate first ends thereof to the bottom member of the frame, the bands of elastic material having an elongation rating of about 100% or more;

looping the bands of elastic material over the top member of the frame;

coupling the bands of elastic material proximate second ends thereof to a bottom of the flexible bag to raise the bottom of the flexible bag toward the top member upon removal of laundry from within the flexible bag; and coupling the liner to the top member of the frame to hang the liner from the frame.

10. The method of claim 9, wherein forming the liner comprises forming the liner to be capable of holding up to about 30 lbs (13.6 kg) of articles of laundry without breaking.

11. The method of claim 9, wherein forming a liner comprises selecting bands of elastic material having a modulus of elasticity of about 2,000 MPa or less.

12. The method of claim 9, wherein forming a liner comprises selecting a flexible bag comprising a woven fabric.

* * * * *